United States Patent [19]

Schimion

[11] Patent Number: 4,467,629

[45] Date of Patent: Aug. 28, 1984

[54] METHOD OF FLATTENING STEEL STRIP IN ROLLING MILL

[75] Inventor: Werner Schimion, Hilchenbach, Fed. Rep. of Germany

[73] Assignee: SMS Schloemann-Siemag AG, Düsseldorf, Fed. Rep. of Germany

[21] Appl. No.: 308,036

[22] Filed: Oct. 2, 1981

[51] Int. Cl.[3] ..... B21B 37/12; B21B 27/10; B21B 45/02

[52] U.S. Cl. ..... 72/17; 72/45; 72/201; 72/236

[58] Field of Search ..... 72/41, 43, 44, 45, 201, 72/236, 8, 9, 12, 17, 34

[56] References Cited

U.S. PATENT DOCUMENTS

| | | | |
|---|---|---|---|
| 2,226,500 | 12/1940 | Matthews | 72/201 |
| 3,150,548 | 9/1964 | Roberts | 72/43 X |
| 3,208,253 | 9/1965 | Roberts | 72/201 X |
| 3,225,580 | 12/1965 | El-Waziri | 72/236 |
| 3,334,508 | 8/1967 | Martin | 72/201 X |
| 3,587,265 | 6/1971 | Sivilotti | 72/201 X |
| 3,616,669 | 11/1971 | Shumaker | 72/200 |
| 3,802,237 | 4/1974 | Albensi et al. | 72/17 |
| 3,803,888 | 4/1974 | Hostetter et al. | 72/45 |

FOREIGN PATENT DOCUMENTS

| | | |
|---|---|---|
| 2750047 | 6/1978 | Fed. Rep. of Germany . |
| 2908641 | 9/1979 | Fed. Rep. of Germany . |
| 1597078 | 7/1970 | France . |
| 2027712 | 10/1970 | France . |
| 2118902 | 8/1972 | France . |
| 2012198 | 10/1977 | United Kingdom . |
| 2015401 | 8/1978 | United Kingdom . |

OTHER PUBLICATIONS

"Zeitverhalten thermischer Walzspaltanderungen beim Kaltwalzen von Band," by Oskar Pawelski, pb. May 1972, Archiv Fur Das Eisenhutten-Wesen, pp. 405–411.

*Primary Examiner*—E. Michael Combs
*Attorney, Agent, or Firm*—Karl F. Ross; Herbert Dubno

[57] ABSTRACT

A steel strip is first passed longitudinally in a predetermined travel direction through a nip between a pair of parallel rolls, and then passed downstream in the direction from the rolls over a sensor that engages the strip at a plurality of zones spaced apart on the strip transverse to the direction. The sensor generates respective output signals corresponding to the deviations from planarity of the strip at the zones. A treatment liquid is sprayed uniformly and at a relatively high temperature on the rolls while respective streams of a coolant liquid at a relatively low temperature are directed at regions of the rolls corresponding to the zones. The heat exchange between the streams and the rolls is varied in accordance with the respective output signals to thermally change the diameters of the rolls in the respective regions and thereby eliminate the deviations in planarity detected by the sensor. Thus the treatment liquid can be applied to the rolls at the ideal temperature and rate of flow for best treatment—mainly lubrication and cleaning—of the working rolls. The coolant liquid, which may be the same or a more diluted version of the same liquid, is applied at a much lower temperature and at a rate of flow calculated exclusively to effect the desired heat exchange and thermally change the roll diameter in the respective region to the extent necessary to roll out the deviations in planarity in the respective strip zones.

7 Claims, 5 Drawing Figures

METHOD OF FLATTENING STEEL STRIP IN ROLLING MILL

FIELD OF THE INVENTION

The present invention relates to a method of flattening steel strip in a rolling mill. More particularly this invention concerns a method for use at the extreme downstream end of a rolling line to remove the last deviations in planarity from a steel strip being rolled.

BACKGROUND OF THE INVENTION

When rolling sheet steel in a so-called cold-rolling mill to reduce its thickness and give the steel the desired finish, the rolling process inevitably stretches the strip longitudinally and thereby deforms the strip from its original planarity. Complex mechanical procedures have been suggested to bias the last pair of working rolls together in such a way as to roll out the deviations from planarity. Such procedures normally are, however, quite crude and cannot react rapidly to temporary deviations from planarity in the workpiece to correct them during the run.

It has been suggested in German patent document No. 2,908,641 based on a Dutch application filed Mar. 6, 1978 by H. K. Quere and A. J. Tychon to flatten aluminun strip by thermally changing the diameter of regions of the last working rolls in the aluminum-strip mill. To this end the strip passes as it exits from the last roll stand over a sensing device subdivided into a plurality of zones spaced apart on the strip transverse to the strip displacement direction and set up to generate respective output signals corresponding to the deviations from planarity of the strip at these zones. Respective streams of a treatment liquid are sprayed at regions of the rolls of the last stand corresponding to the zones to effect the required slight diameter change. If the rolls need to be of larger diameter they are cooled less so that they heat up and expand, and vice versa. In this manner an extremely fine control of the roll diameters can be obtained starting from conventional cylindrical rolls. The heat exchange can be varied by changing the temperature of the treatment liquid or its rate of flow.

Such a procedure cannot, however, be used with steel strip, even though, or actually because, it is standard practice to spray the working rolls in a steel mill with a treatment liquid that serves the functions of lubricating, cleaning, and even cooling. This liquid is normally an oil/water emulsion that must be delivered to the working rolls at a certain temperature and at a certain rate that is a function of volume of treatment liquid per unit of surface area of the working roll per unit of time. Normally the liquid is relatively warm—40°-50° C.—for proper emulsification and chemical action. If the temperature of the emulsion is not right the viscosity and droplet size will be less than or greater than what is needed, or any detergent or other surface active agent in the treatment liquid will be less effective than intended. Changing the rate of flow can lead to dangerous underlubrication of the rolling process whereas increasing it can cause slippage.

OBJECTS OF THE INVENTION

It is therefore an object of the present invention to provide an improved rolling method.

Another object is the provision of such a rolling method which overcome the above-given disadvantages.

A further object is to provide a way of flattening steel strip by thermally varying working-roll diameter.

SUMMARY OF THE INVENTION

These objects are attained according to the instant invention in a method of rolling a steel strip. The method according to the instant invention comprises the steps of passing the strip longitudinally in a predetermined travel direction through a nip between a pair of parallel rolls, passing the strip downstream in the direction from the rolls over a sensor that engages the strip at a plurality of zones spaced apart on the strip transverse to the direction, generating respective output signals corresponding to the deviations from planarity of the strip at the zones, spraying a treatment liquid uniformly and at a relatively high temperature on the rolls, directing respective streams of a coolant liquid at a relatively low temperature at regions of the rolls corresponding to the zones, and varying the heat exchange between the streams and the rolls in accordance with the respective output signals to thermally change the diameters of the rolls in the respective regions and thereby eliminate the deviations in planarity detected by the sensor.

Thus with the system according to the instant invention the treatment liquid can be applied to the rolls at the ideal temperature and rate of flow for best treatment—mainly lubrication and cleaning—of the working rolls. The coolant liquid, which may be the same or a more diluted version of the same liquid, is applied at a much lower temperature and at a rate of flow calculated exclusively to effect the desired heat exchange and thermally change the roll diameter in the respective region to the extent necessary to eliminate the deviations in planarity in the respective strip zones. In fact the flow of the coolant liquid can be interrupted wholly at times when the roll diameter is to be maximized.

In accordance with another feature of the invention, the heat exchange between the streams and the rolls is varied in analog fashion in direct proportion to the respective deviations from planarity. Thus the flow or the liquid temperature is varied steplessly.

It is also possible in accordance with the invention for the streams to be varied in on-off control fashion in accordance with a predetermined set point. So-called two-point or three-point control as described at pages 22-13ff of *Chemical Engineers' Handbook* of R. H. Perry and C. H. Chilton (McGraw/Hill: 1973) can be used.

According to another feature of the invention the output signals can be averaged and the averaged output signal is used as the set point. In this manner it is possible to achieve almost perfect planarity with minimal equipment.

The streams according to the present invention are directed at the rolls immediately upstream of the nip. The treatment liquid is sprayed on the rolls between the coolant-liquid streams and the nip. Thus the coolant liquid will have plenty of time to act, but the treatment liquid will still be applied where it must do most of its work, at the nip.

An apparatus for carrying out the method of the instant invention comprises a pair of rolls defining a nip, a sensor downstream from the nip in a predetermined travel direction, means for passing the strip longitudinally in the predetermined travel direction through the nip and downstream in the direction from the rolls over the sensor, means at the sensor for generating respective output signals corresponding to the deviations from planarity of the strip at zones spaced apart on the strip transverse to the direction, means for spraying a treatment liquid uniformly and at a relatively high temperature on the rolls, means including nozzles for directing respective streams of a coolant liquid at a relatively low temperature at regions of the rolls corresponding to the zones, and control means for varying the heat exchange between the streams and the rolls in accordance with the respective output signals to thermally change the diameters of the rolls in the respective regions and thereby eliminate the deviations in planarity detected at the sensor.

It is possible to retrofit an existing roll stand with the system of the instant invention. The extra nozzles for the coolant liquid and the sensor and attached control means are all that need be added.

According to the invention the nozzles are upstream in the direction of the rolls and are directed downstream thereat. The treatment liquid is sprayed onto the rolls between the streams of the coolant liquid and the nip relative to the rotation direction of the rolls. The nozzles are mounted on respective nozzle beams adjacent the rolls and each carrying a plurality of such nozzles. The control means includes respective nozzle-control valves in the beam at the respective nozzles. In a pulse-type system according to this invention, the nozzles have full-on positions and full-off positions only.

For most compact construction each of the valves is immediately adjacent the respective nozzle. Furthermore the apparatus further has respective coolant and treatment supplies of the liquids and relatively short conduits connecting same to the respective means. Means is provided for trapping the liquids underneath the rolls and for returning the trapped liquid to the treatment supply. Thus the coolant liquid will be at best a diluted version of the treatment liquid, but since viscosity, drop size, and the like are largely irrelevant to heat-exchange, this use of runoff treatment liquid as coolant liquid represents a worthwhile saving. In such a system means is provided, if necessary, for withdrawing the treatment liquid from the treatment supply, for cooling the treatment liquid, and for introducing the cooled treatment liquid as the coolant liquid into the coolant supply. Thus the coolant supply is a reservoir separate from the treatment supply. The reservoir for the coolant liquid according to this invention is connected to means for cooling the coolant liquid.

According to other features of this invention the apparatus also includes a pair of second rolls immediately upstream of the first-mentioned rolls and defining a nip, the strip passing longitudinally in the direction through both of the nips, means including nozzles for directing respective streams of the coolant liquid at the relatively low temperature at regions of the second rolls corresponding to the zones, and second control means for varying the heat exchange between the streams and the second rolls in accordance with the respective output signals to thermally change the diameters of the second rolls in the respective regions and thereby eliminate the deviations in planarity detected at the sensor. Advantageously according to another feature of the invention the second control means varies the heat exchange between the streams and the second rolls less relative to the outputs than the first-mentioned control means. This is achieved by damping the reaction of the second control means or giving it a flatter response characteristic.

DESCRIPTION OF THE DRAWING

The above and other features and advantages will become more readily apparent from the following, reference being made to the accompanying drawing in which.

SPECIFIC DESCRIPTION

Figure 1:
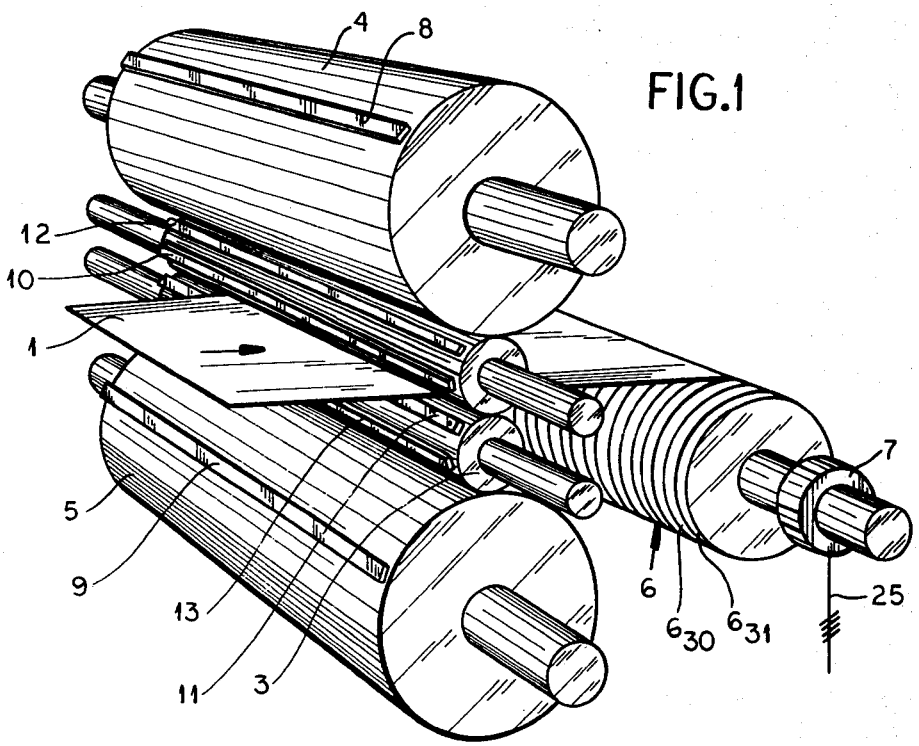
FIG. 1 is a perspective view of an apparatus according to the instant invention.

As seen in FIG. 1 a steel strip 1 passes through the nip defined between a pair of parallel small-diameter working rolls 2 and 3 pressed together by respective large-diameter backing rolls 4 and 5. The strip 1 then passes over a sensor roller 6 of the type described in the ASEA brochure AV 83-102 T of October 1971 (first edition). This sensor roller 6 is subdivided into a multiplicity, here thirty-one, of zones $6_1$–$6_{31}$ and can generate thirty-one different outputs corresponding to the force with which the strip bears radially against the roll 6 at the respective zones $6_1$–$6_{31}$. As a rule such a roll 6 has a stack of limitedly radially displaceable disks constituting the zones and is provided internally with respective radially braced strain gauges to form varying-resistance outputs corresponding to the deviation from planarity of the respective portion of the strip. These outputs are transmitted via a multipart commutator ring 7 to a multiconductor cable 25.

Standard nozzle beams 8 and 9 spray a treatment liquid constituted as an oil/water/detergent emulsion on the backing rolls 4 and 5 and similar such nozzle beams 10 and 11 spray such a treatment liquid on the two working rolls 2 and 3. Such liquid has a temperature of about 45° C. so that it has the proper viscosity and droplet size in the spray. In a system using more than one backing roll extra such beams are provided for the extra rolls. Palm oil or the like, as discussed on page 968ff of *The Making, Shaping and Treating of Steel* (US Steel: 1971) is used as so-called flood lubrication and must be applied at the given temperature or it clots and the emulsion cannot be sprayed.

Figure 3:
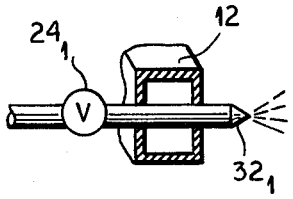
FIG. 3 is a cross section through a nozzle beam according to the invention.

According to the instant invention the work rolls 2 and 3 are associated with respective spray beams 12 and 13 provided with nozzles $24_1$–$24_{31}$, corresponding to the thirty-one zones $6_1$–$6_{31}$ of the sensor roller 6. These nozzles $24_1$–$24_{31}$ are associated with respective valves $32_1$–$32_{31}$ carried right on the beams as shown in FIG. 3. Two nozzles may be provided for each zone $6_1$–$6_{31}$ or even four, but all the nozzles for each such zone are controlled by a single respective valve. The nozzles $24_1$–$24_{31}$ spray a coolant liquid at 25° C. on the rolls 2 and 3 at locations upstream relative to the rotation directions of the rolls 2 and 3 from the respective treatment-liquid spray beams 10 and 11.

Figure 2:
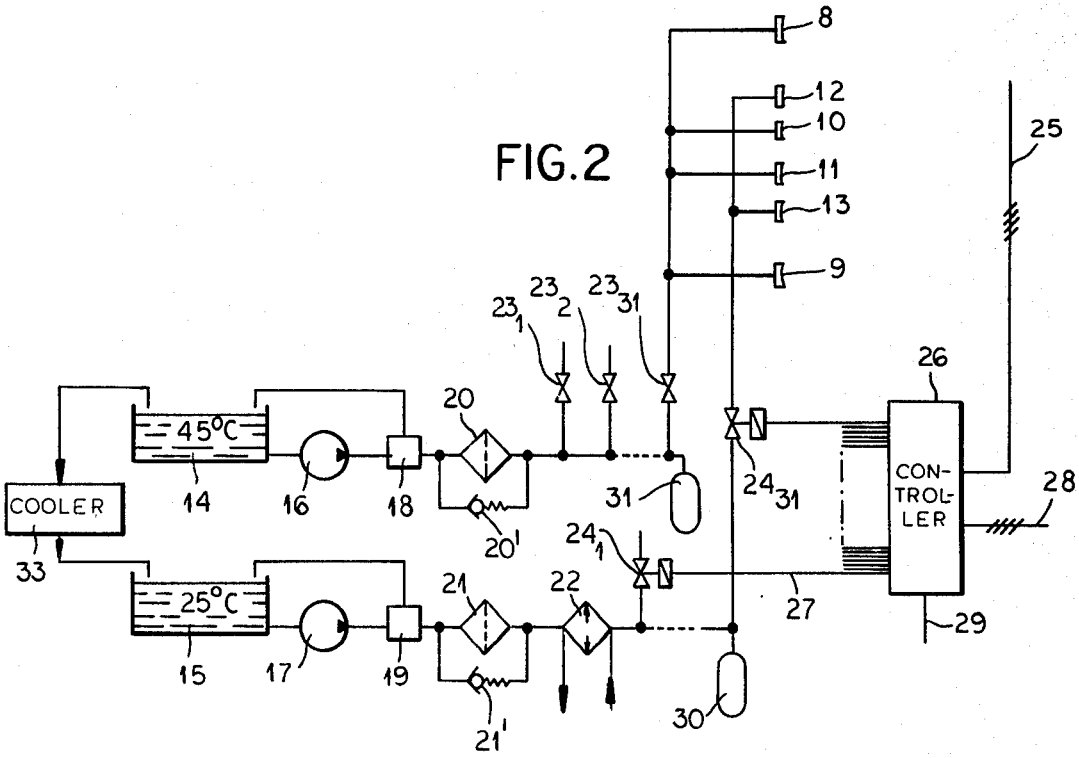
FIG. 2 is a schematic diagram of the apparatus of this invention.

FIG. 2 shows how the 45° C. treatment liquid is held in a supply reservoir 14 and the 25° C. coolant liquid in a supply reservoir 15 which may be maintained full by liquid passed from the reservor 14 through a cooler 33 into the reservoir 15. The reservoirs 14 and 15 are connected to the inputs of respective pumps 16 and 17 that force the respective liquids through respective pressure-limiting valves 18 and 19 and filters 20 and 21. The valves 18 and 19 have drains directed back into the respective reservoirs 14 and 15 so that any overpressure liquid is returned, and the filters 20 and 21 are shunted by heavily spring-loaded check valves 20' and 21' which only permit liquid to flow when substantial back pressure is created in the respective filters 20 and 21, as when they become clogged.

From the filter 20 the treatment liquid flows to respective valves $2_{31}$–$23_{31}$ which are mounted on the beams 8–11 and associated wih the respective zones $6_1$–$6_{31}$. These valves $2_{31}$–$23_{31}$ are manually adjusted at the start of the process to achieve best lubrication, and a pressure accumulator 31 is provided to keep the treatment liquid flowing.

Figure 5:
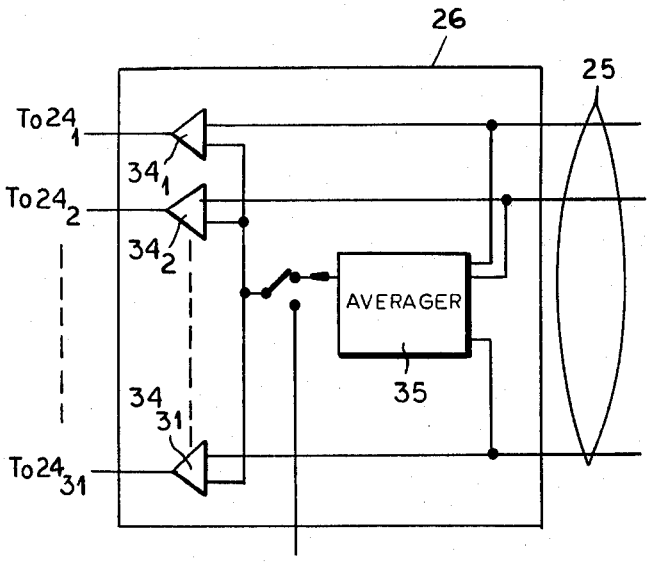
FIG. 5 is a schematic diagram of a detail of the apparatus of FIG. 2.

The coolant liquid is fed from the filter 21 through a cooler 22 if needed and then to the valves $24_1$–$24_{31}$ which are individually operated by a controller 26 receiving thirty-one actual-value signals via the input line 25 from the sensor roller 6. As shown in FIG. 5 this controller 26 may incorporate respective comparators $34_1$–$34_{31}$ each having one input that is connected to one of the inputs of the line 25 and another input which may receive a set-point signal from an averager 35 or another set-point signal from an external source 29. It is also possible for respective control signals to be fed into the controller 26 from a multiconductor source 28. When the averager 35 is used the system will automatically seek to adjust for all of the signals from the zones $6_1$–$6_{31}$ of the sensor 6 to be the same, which will occur when the strip 1 is perfectly flat and planar. The valves $24_1$–$24_{31}$ are of the on-off type, that simply open when the respective comparator conducts as the respective input exceeds the set point.

Figure 4:
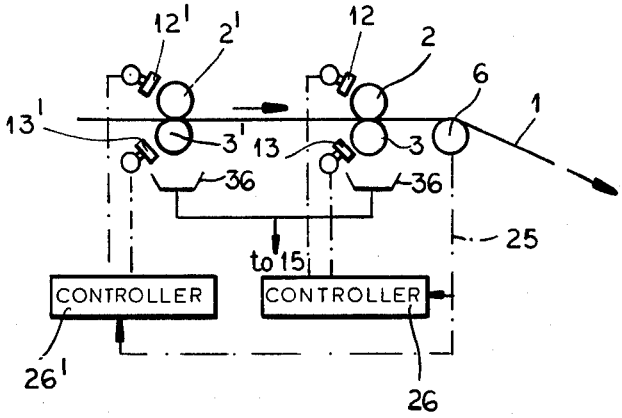
FIG. 4 is a small scale also largely schematic view of another apparatus according to the invention.

It is also possible as shown in FIG. 4 for the system to use a second controller 26' associated like the controller 26 with spray beams 12' and 13' of a pair of working rolls 2' and 3' immediately upstream of the rolls 2 and 3. This controller 26' is damped or operates with a flatter response characteristic than the controller 26 so that it effects a partial preliminary correction of deviations from planarity in the strip 1. FIG. 4 also shows how sumps or basins 36 under the sets of rolls 2, 3 and 2', 3' can catch the liquid flowing off them and return it to the reservoir 15 for chilling and use as the coolant liquid. Normally the sensor roller 6 only lies some 1.0–2.0 m behind the nip between the rolls 2 and 3, so that relatively fast response is achieved. The thermal inertia of the rolls therefore has minimal effect on the measurement and the system largely avoids hunting. In addition it is standard to provide an indicating arrangement to show the operator of the system the various deviations from planarity, to verify if something need be done further upstream to eliminate a recurring problem.

The system according to the instant invention therefore allows steel strip to be flattened in a manner hitherto only applicable to aluminum strip. The system works completely automatically and produces a high-quality product.

I claim:

1. A method of rolling a steel strip, said method comprising the steps of:

passing said strip longitudinally in a predetermined travel direction through a nip between a pair of parallel rolls;

passing said strip downstream in said direction from said rolls over a sensor that engages said strip at a plurality of zones spaced apart on said strip transverse to said direction;

generating respective output signals coresponding to the deviations from planarity of said strip at said zones;

directing streams of cooling and lubricating liquid at a constant flow rate at said rolls uniformly over all the regions of the said rolls corresponding to said zones, these streams being of the minimum amount necessary to the lubrication of the said rolls, and having a temperature conducive to the lubrication of the said rolls, directing additional streams of at least one other liquid, at the regions of said rolls corresponding to said zones, controlling the amount of the stream of this other liquid being applied within each of the regions by the respective one of the said output signals for varying the stream between 0 to 100 percent of a maximum stream thereof, the temperature of this other liquid being lower than that of the first-mentioned liquid referred to in the preceding paragraph for varying the heat exchange between said streams and said rolls in accordance with the respective output signals to thermally change the diameters of said rolls in the respective regions and thereby eliminate the deviations in planarity detected by said sensor.

2. The method defined in claim 1, wherein the said liquids are of the same composition, and the used liquids are collected in a supply reservoir, from which the higher temperature liquid is taken, while the lower temperature is taken from a further reservoir filled out of the first-mentioned reservoir via a cooler.

3. The method defined in claim 1 wherein heat exchange between said streams and said rolls is varied in an analog fashion in direct proportion to respective deviations from planarity.

4. The method defined in claim 1 wherein said streams of said other liquid are varied in on-off control fashion in accordance with a predetermined setpoint.

5. The method defined in claim 4, further comprising the steps of averaging said output signals and using the averaged output signals as said setpoint.

6. The method defined in claim 1 wherein said streams are directed at said rolls immediately upstream of said nip.

7. The method defined in claim 6 wherein still another liquid is sprayed on said rolls between said streams and said nip.

* * * * *